US007367592B1

(12) United States Patent
Puttkammer et al.

(10) Patent No.: US 7,367,592 B1
(45) Date of Patent: May 6, 2008

(54) MARKING SUBSTANCE AND SECURITY MARKINGS FOR TESTING THE AUTHENTICITY OF DOCUMENTS

(75) Inventors: Frank Puttkammer, Coswig (DE); Monika Puttkammer, Coswig (DE); Gunther Zscherpe, Sosa (DE)

(73) Assignee: WHD Elektronische Prueftechnik GmbH, Dresden (DE)

( * ) Notice: Subject to any disclaimer, the term of this patent is extended or adjusted under 35 U.S.C. 154(b) by 0 days.

(21) Appl. No.: 09/719,881

(22) PCT Filed: Jun. 15, 1999

(86) PCT No.: PCT/DE99/01806

§ 371 (c)(1),
(2), (4) Date: Jan. 10, 2001

(87) PCT Pub. No.: WO99/66128

PCT Pub. Date: Dec. 23, 1999

(30) Foreign Application Priority Data

| | | |
|---|---|---|
| Jun. 16, 1998 | (DE) | 198 26 800 |
| Aug. 12, 1998 | (DE) | 198 36 503 |
| Mar. 27, 1999 | (DE) | 199 15 440 |
| Jun. 15, 1999 | (DE) | 199 28 059 |

(51) Int. Cl.
*B42D 15/00* (2006.01)
*D21F 11/00* (2006.01)

(52) U.S. Cl. ..... 283/83; 283/901; 162/110; 162/140; 428/209

(58) Field of Classification Search ..... 283/67, 283/70, 72, 83, 94, 95, 98, 107, 109, 113, 283/901, 902; 430/527, 530, 529; 162/134, 162/110, 140; 428/209
See application file for complete search history.

(56) References Cited

U.S. PATENT DOCUMENTS

| | | | | |
|---|---|---|---|---|
| 5,112,672 A * | 5/1992 | Kaule et al. | ..... | 428/209 |
| 5,928,471 A * | 7/1999 | Howland et al. | ..... | 162/110 |
| 6,025,119 A * | 2/2000 | Majumdar et al. | ..... | 430/529 |

* cited by examiner

*Primary Examiner*—Willmon Fridie, Jr.
(74) *Attorney, Agent, or Firm*—Neifeld IP Law, PC

(57) ABSTRACT

The invention relates to a marking substance for security documents of the kind difficult to discern by counterfeiters. The preferred marking substance is polyethylene dioxythiophene polystyrene sulfonate and, more particularly, PEDT/PSS of the CPP105 formulation.

18 Claims, 11 Drawing Sheets

MARKING SUBSTANCE AND SECURITY MARKINGS FOR TESTING THE AUTHENTICITY OF DOCUMENTS

BACKGROUND OF THE INVENTION

1. Field of the Invention

The invention relates to a marking substance for security elements used to examine the authenticity of documents such as bank notes and the like.

In order to raise the level of certainty against counterfeiting, marking substances are incorporated in paper pulp lines used in the manufacture of documents such as bank notes as well as of other products. Light-activated marking substances hitherto used are at present readily available in the market place, so that counterfeiters are in a position to falsify security elements fabricated with such marking substances.

2. The Prior Art

In this connection, EP 753 623 discloses a security sheet with an electrically conductive element. The security sheet consists of a carrier matrix of predetermined fiber structure, and its conductive element is a security thread constituted by a foil. The foil is coated with an electrically conductive polymer from the group of polythiophenes. The electrically conductive polymer is applied to the foil in liquid or dispersed form.

U.S. Pat. No. 5,112,672 discloses a security document with an imbedded electrically conductive security thread. The security thread is coated with a metal which in turn is provided with an electrically conductive polymer for bridging any interruptions.

U.S. Pat. No. 5,419,424 discloses a device for testing the security thread in bank notes. The testing device is provided with sensor electrodes which detect the security thread by capacitive coupling.

DE 43 34 797 discloses a method of fabricating counterfeit-proof documents as well as a method of testing their authenticity. The documents contain a grid work of metal wires which are contacted at their junctions.

In EP 839 950 there is disclosed a method of incorporating substances in a running fibrous web. The substances are introduced into the fibre suspension at or ahead of the site where the web enters into the machine. The substances are introduced at several sites distributed over the width of the fiber web, and at least one site the substances are introduced intermittently.

In order in such circumstances to put up barriers against counterfeiters complicated processes have been devised using light-activated marking substances in which, as described in German patent specification DE 196 53 423, light absorbing substances are additionally used which are invisible to the naked eye. In this manner printed images with noticeable error sections are generated when conducting tests under infra-red light.

Furthermore, to improve the safety against counterfeiting, marking substances are applied in a predetermined distribution to a web of paper to render their authenticity machine-readable. In accordance with DE 197 14 519 substances not visible by humans are used for this purpose, which are superimposed as linearly designed markings on a visible printed image. Because of its physical property the marking substance is supposedly detectable by a machine. Electrical conductivity is mentioned, among others, as one of the physical properties; however, there is no teaching of any marking substance which is invisible to the human eye.

A security element currently commonly used in bank notes is embodied by a foil structure consisting at least of a support foil and a metallization applied to the support foil. A so-called security thread is embedded, either completely or with windows (interruptions), into the paper web. Originally, such a security thread including recognizable demetallized sections shaped as symbols or letters served only for visual testing by humans. In attempting to improve the safety against counterfeiting, additional testing of the electrical conductivity of the metallization was being considered. However, until now, the realization of such attempts has been frustrated, on the one hand, not only by the high mechanical wear suffered by bank notes as a result, for instance, of creasing and folding by a user, but also by bending in automatic teller machines and counting machines. On the other hand, even during the technological process of manufacturing the paper the foil structure, as a result of tension and bending, is already subjected to considerable stress. There will thus occur randomly distributed fine hairline fissures in the metallization which render any test result uncertain and not reproducible. However, to counteract counterfeiting of these security elements, it is not only necessary to prove the presence of a metallization in bank notes, but authenticity must be recognized on the basis of measuring a certain conductivity value. In principle, this problem cannot be solved by the use of metallically acting printing inks instead of vapor deposited metallizations, as proposed by DE 43 44 553 and EP 0 659 587.

Since electrical conductivity is one of the most essential properties of metals, it seems to be obvious that counterfeiters will assume the electrical conductivity of a metallization. In fact, technological equipment is currently readily available for incorporating actual metallizations including their image-like designs as counterfeits of a security element into documents, securities, bank notes, wrappings or products. However, since electrical conductivity is a testing parameter which can be detected quickly and with certainty, no desire exists at present to do away with this security element. It is an additional disadvantage that the properties of the metallization which is visible to the human eye are substantially constant, as for the majority of users it is to serve as a constant security element always recognizable in the same manner. Finally, a relatively large number of persons is familiar with the secrets connected with the fabrication and testing of this humanly recognizable security element, so that the size and undefinability of this group of persons introduces a further risk potential.

OBJECTS OF THE INVENTION

It is, therefore, an object of the invention to propose an electrically conductive marking substance which does not suffer from the disadvantages mentioned above. It is a further object of the invention to propose a marking substance which contributes to improving the certainty against counterfeiting because the necessity has arisen of providing a further easily variable security element which draws less attention to itself than does the metallization which is recognizable by the naked eye, or to propose a security element at varying positions where it is not expected and where it can only be detected by extremely accurate testing technology. These security enhancing characteristics and elements are either integrated into the paper pulp line or applied to the dried paper line.

BRIEF SUMMARY OF THE INVENTION

In accordance with the invention, the object is accomplished by an electrically conductive marking substance constituted by an electrically conductive polymer for integration in paper pulp lines of documents, securities and bank notes to be incorporated as security elements in paper pulp lines for testing of documents, securities, bank notes, wrappers and products or for connection with a support material for fabricating security elements, the preferred marking substance being a polyethylene dioxythiophene polystyrene sulfonate (PEDT/PSS). Other objects will in part be obvious and will in part appear hereinafter.

FIGS. 3, 3*a*, 4, 5, and 6 are drawings relating to the invention.

The advantage provided by the proposal in accordance with the invention is the provision of safety paper with hidden detectable characteristics which cannot be recognized by the naked eye but the homogeneous or partial presence of which can be tested. At the same time, there is the surprising advantage of a continuously operating, time-saving and cost-efficient method of incorporating the marking substance and security elements into the paper pulp line, or of applying it to the dried paper web, with such physical properties of the polyethylene dioxythiophene polystyrene sulfonate (PEDT/PSS) as its good compatibility with the paper being of advantage. Its integration into the paper is substantially less complicated than is the case with solid marking substances. The required concentrations make possible an almost transparent electrically conductive marking.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

Figure 8:
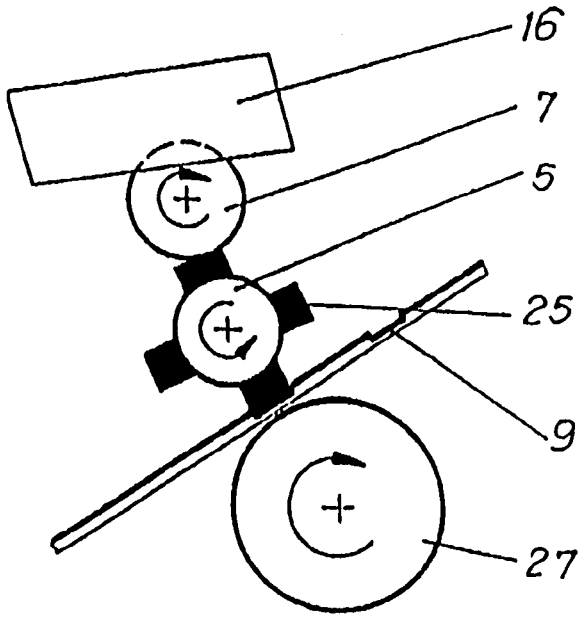
Figure 3A:
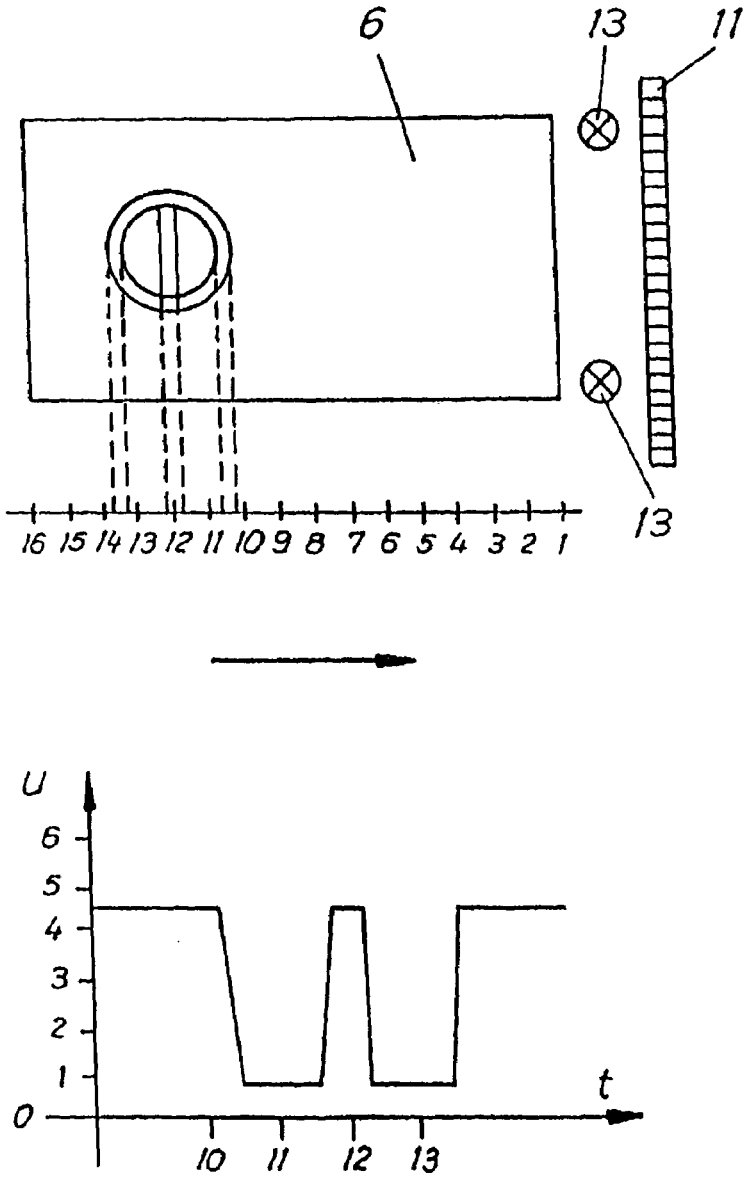
Figure 4:
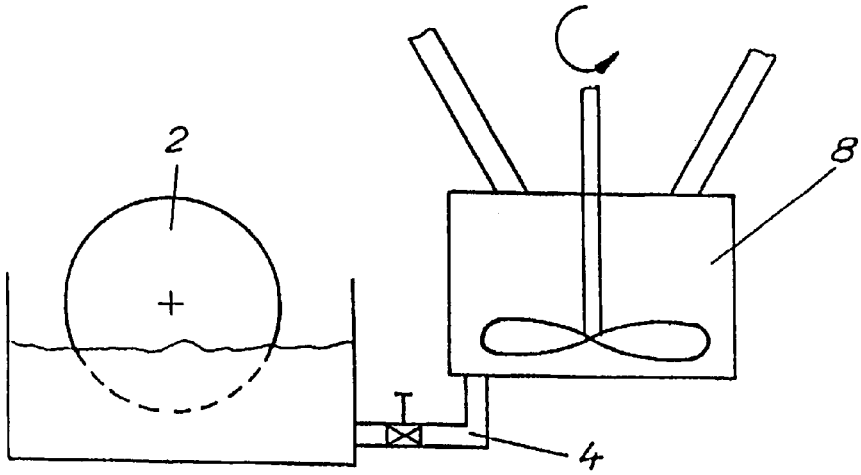
Figure 5:
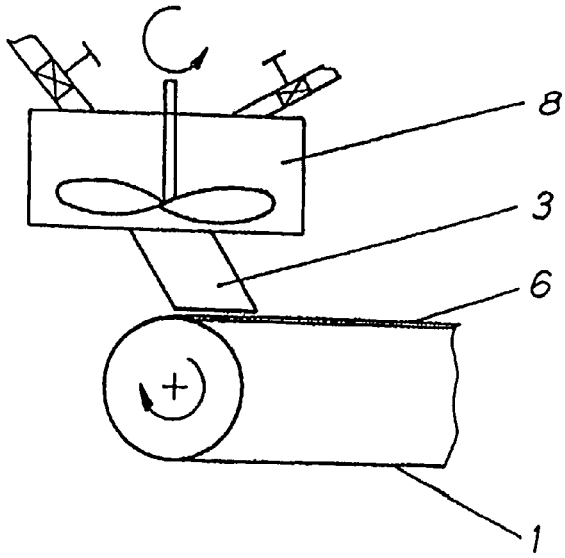
Figure 6:
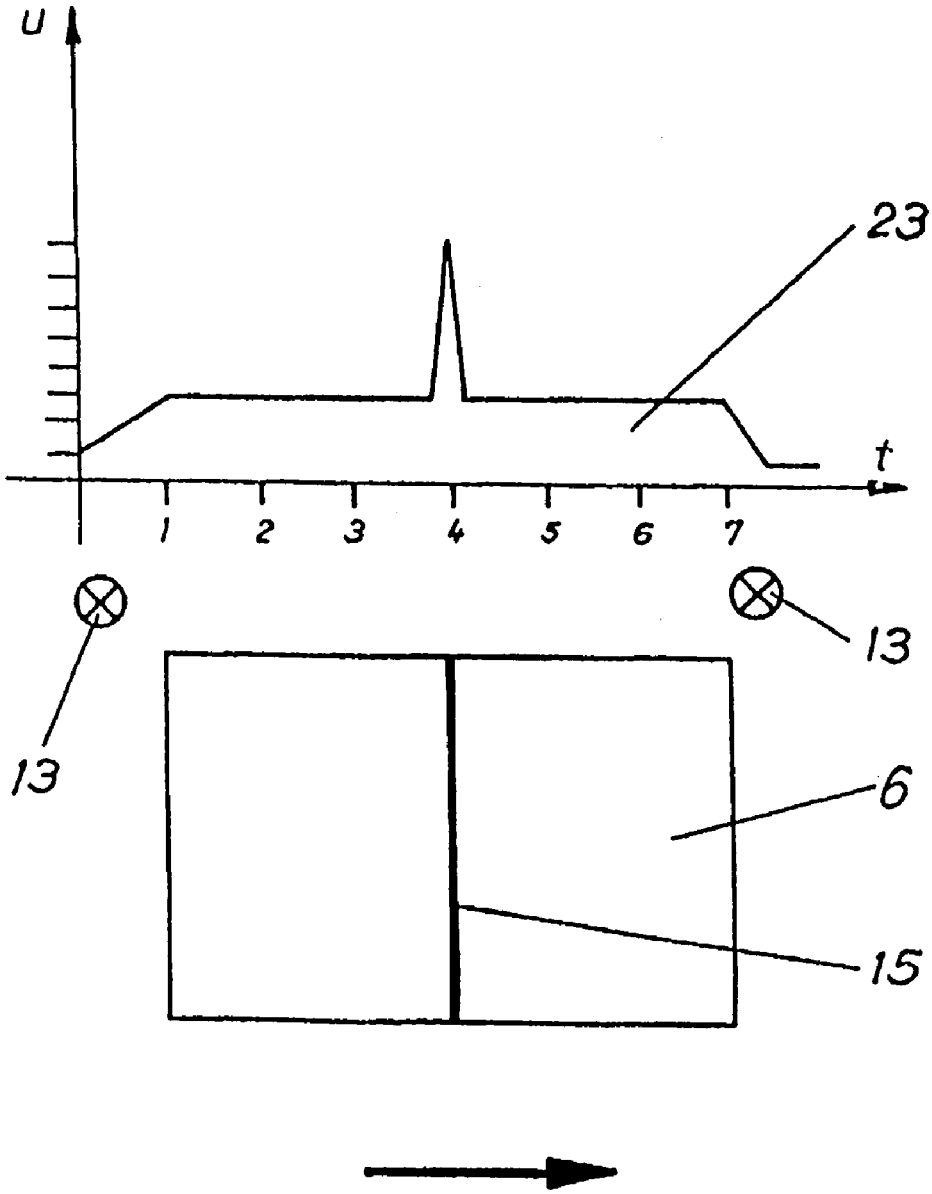
Figure 7:
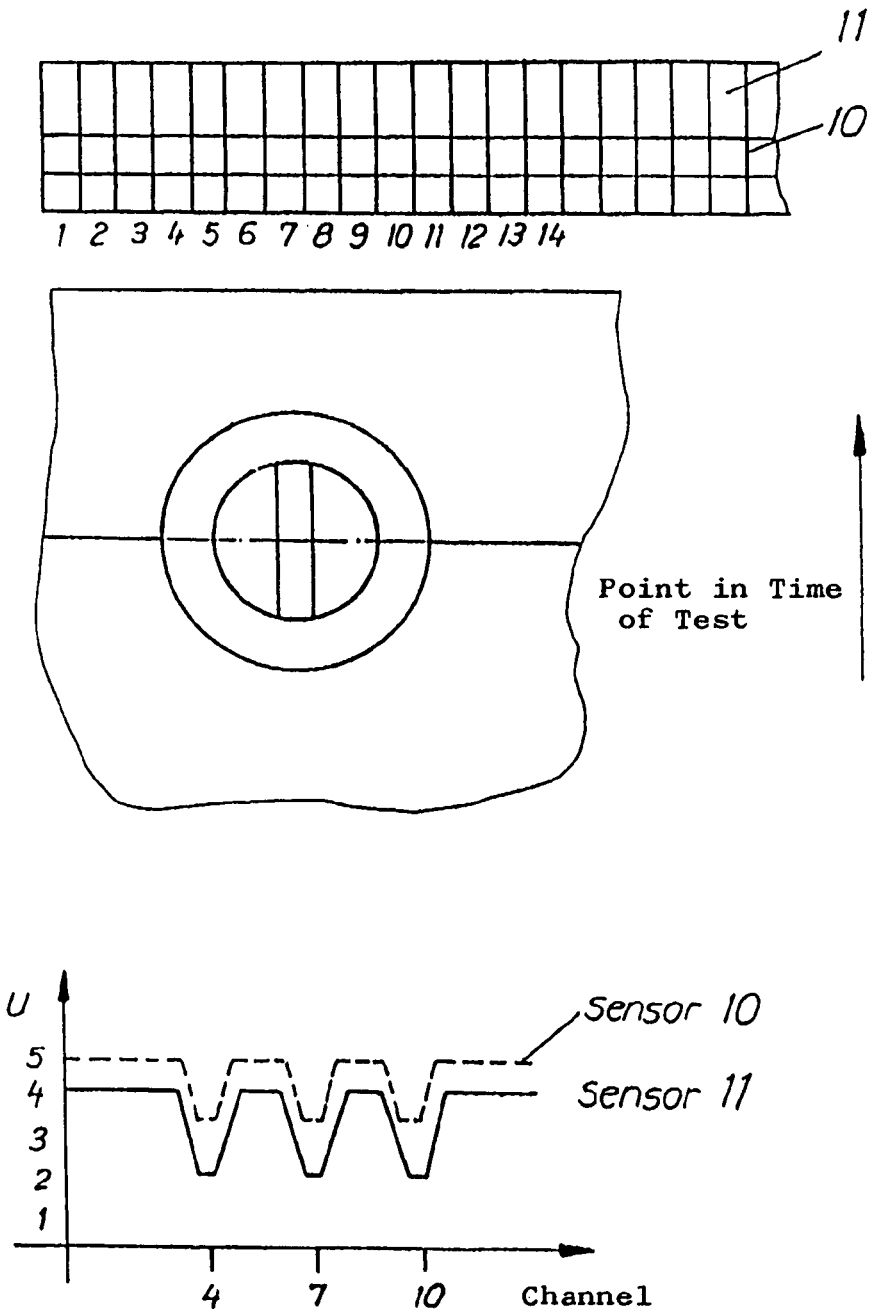
FIG. 7 is a graph of a signal generated by a sensor being swept over a bank note with an electrically conductive water mark.
Figure 7A:
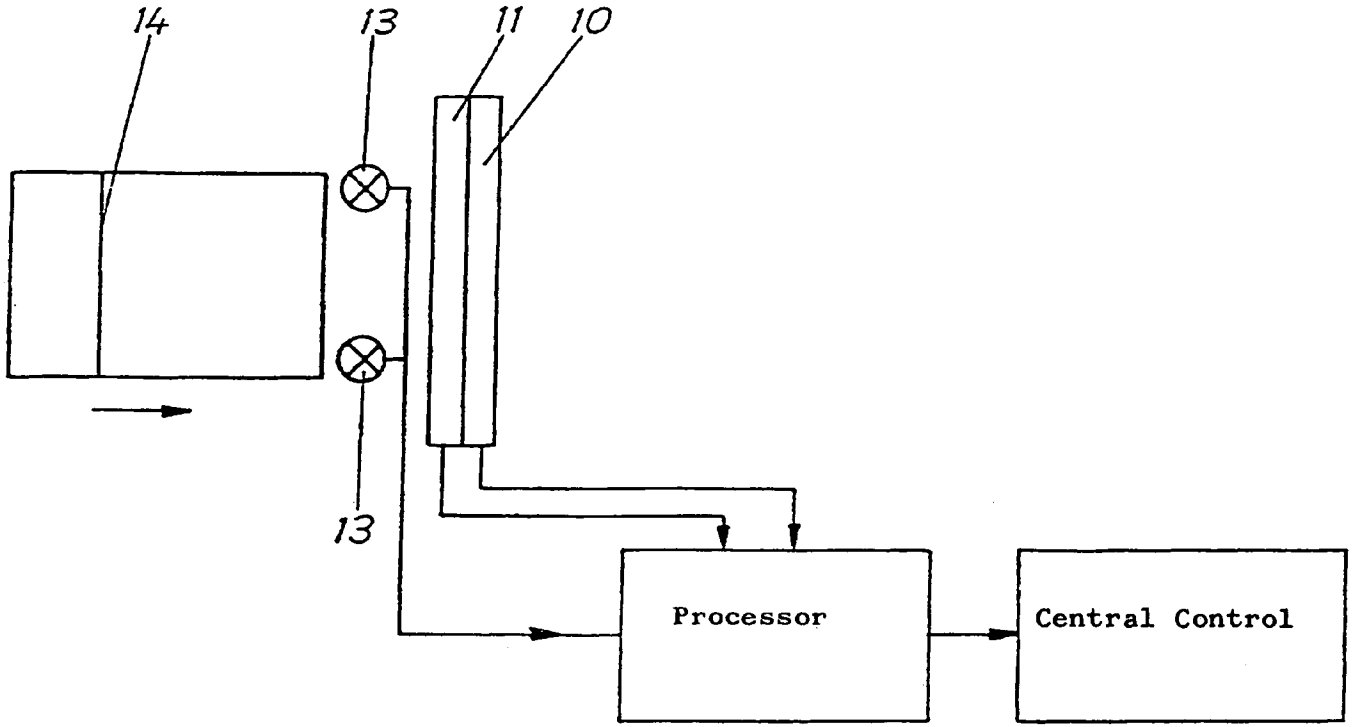
Figure 8A:
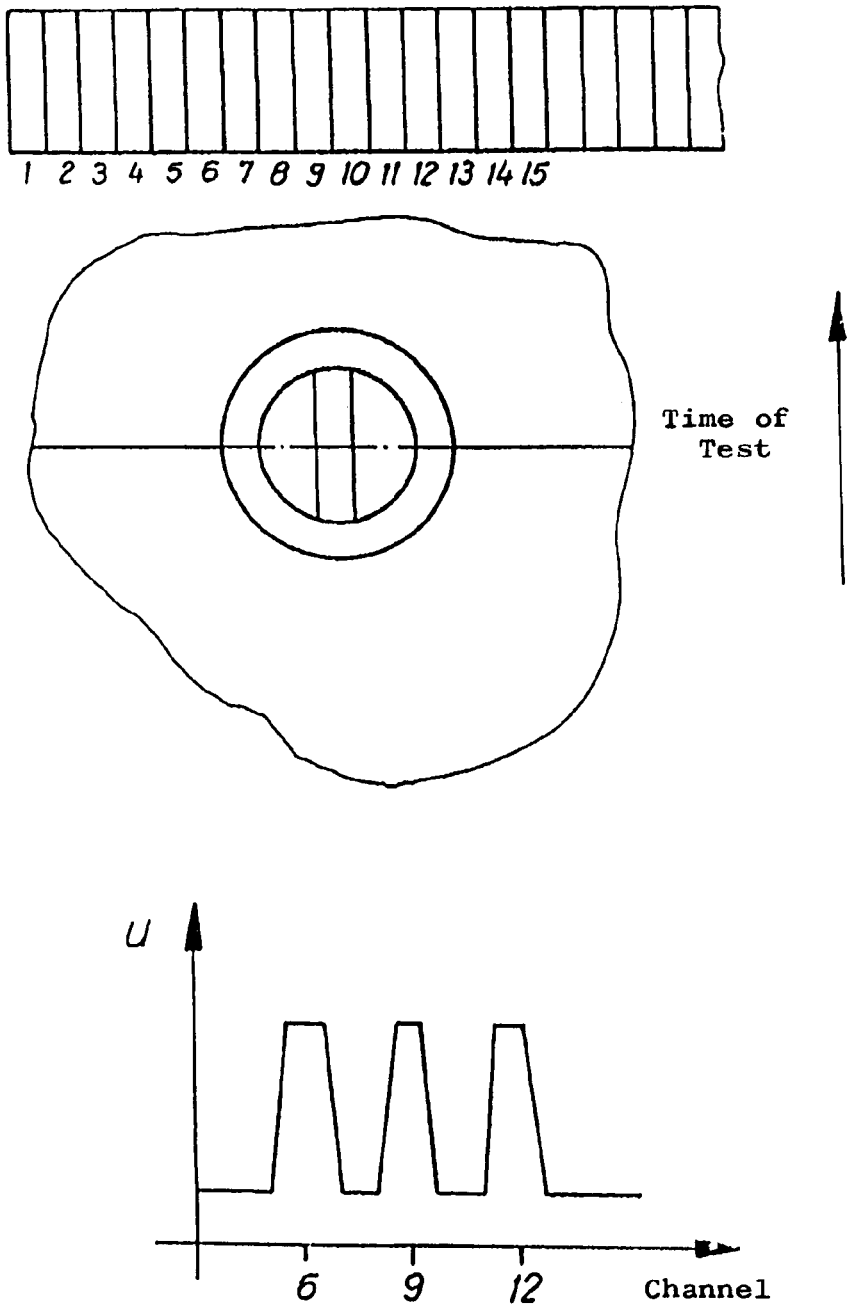
Figure 9:
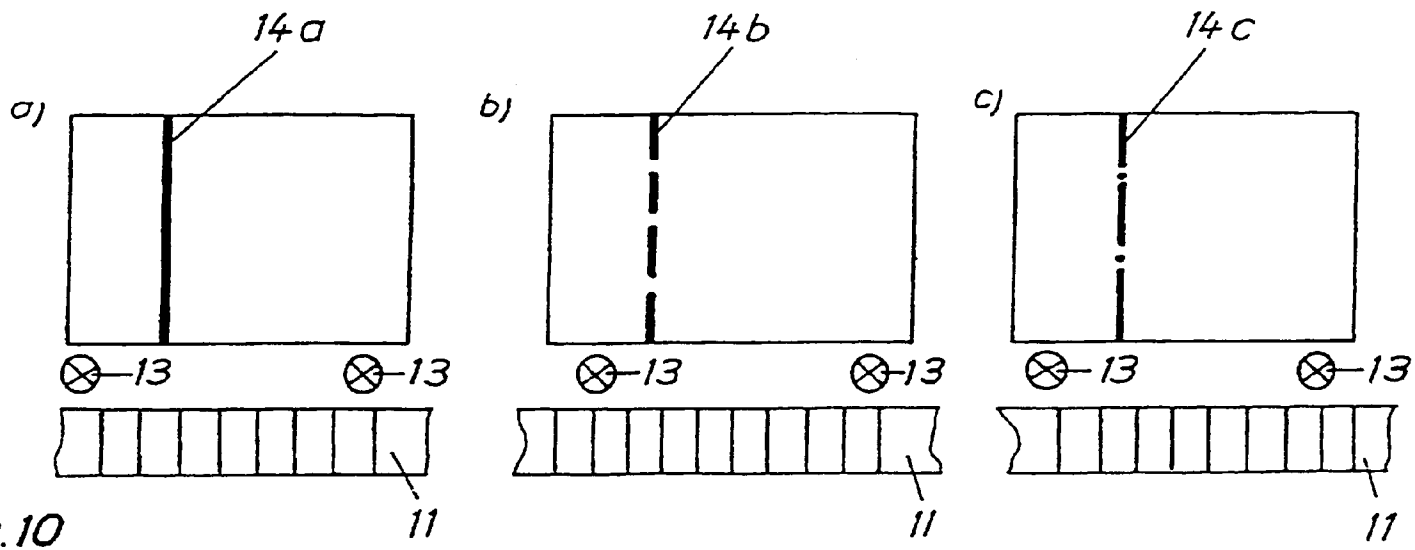
Figure 10:
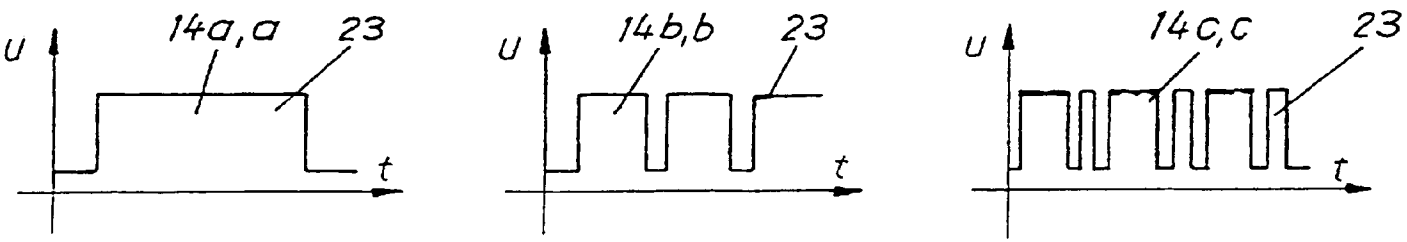
Figure 11:
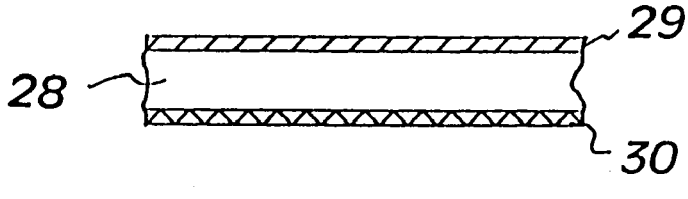
Figure 12:
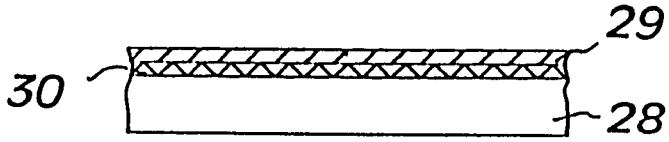
Figure 13:
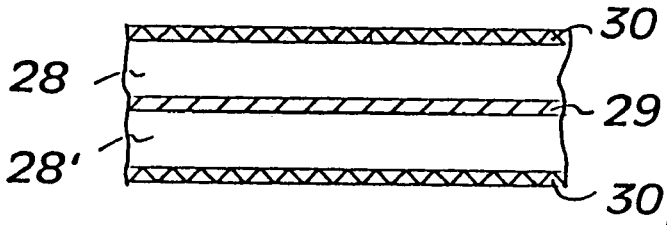
Figure 14:
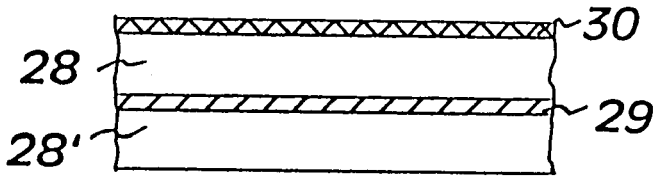

FIG. 7*a* depicts the combining of sensor signals;

FIG. 8 is a schematic side elevational view of a water mark embossing roller with a roller for transferring the marking substance onto a paper pulp line;

FIG. 8*a* is a graph of a signal of an electrically conductive water mark in conventional paper;

FIG. 9 is a schematic presentation of tests by scanning sensors following partial application of marking substance onto a dried paper web or integration of marking substance into the paper pulp line;

FIG. 10 depicts graphs of signals of partial marking substance detection;

FIG. 11 depicts a foil structure with a support foil, a metallization and a further layer of an electrically conductive polymer;

FIG. 12 depicts another foil structure with a support foil, a metallization and a further layer of an electrically conductive polymer;

FIG. 13 depicts a foil structure made of two support foils and a metallization, with each support foil supporting a further layer of an electrically conductive polymer; and FIG. 14 depicts a foil structure made of two support foils, a metallization and a further layer of an electrically conductive polymer.

DETAILED DESCRIPTION OF THE PREFERRED EMBODIMENTS

Figure 1:
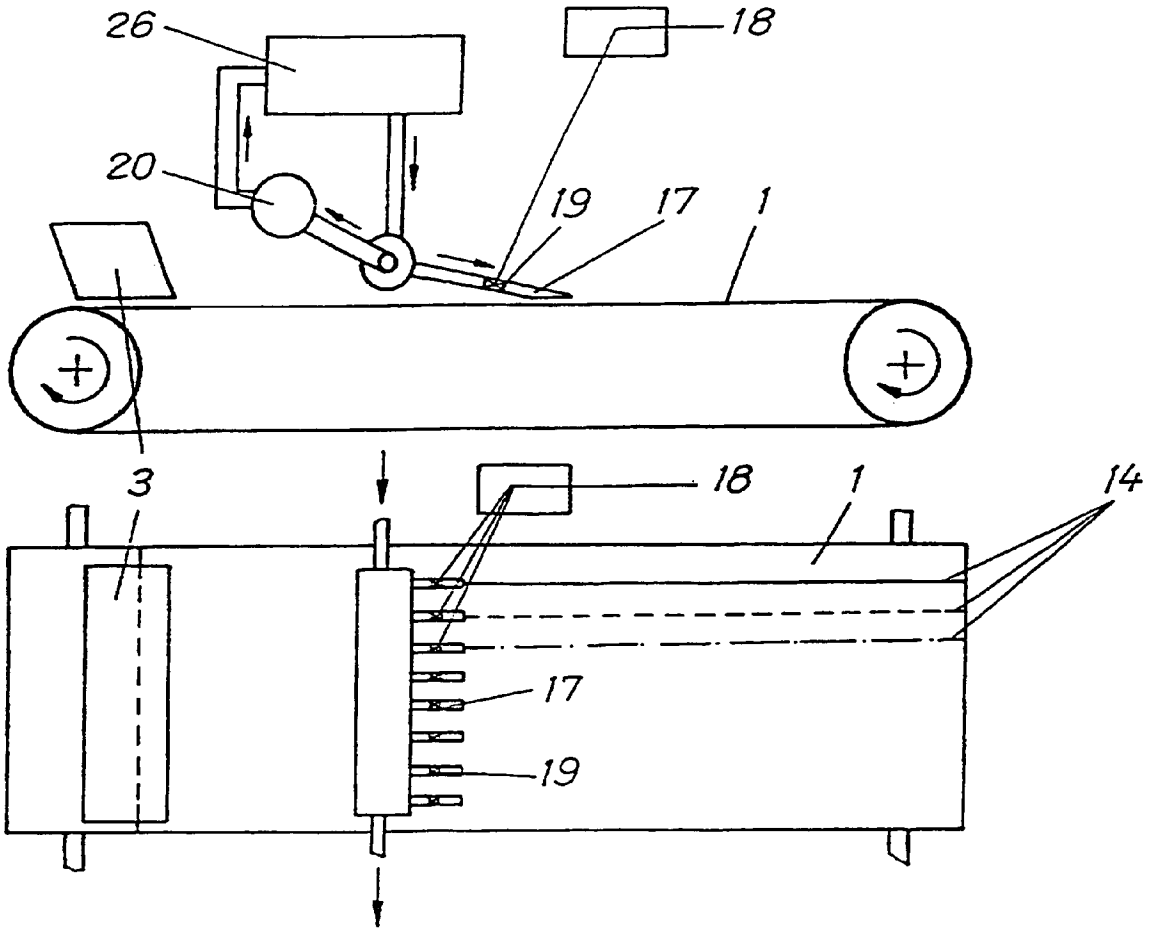
FIG. 1 shows schematic side and top elevational views of a long strainer of a paper making machine to illustrate the method of partial integration of the marking substance in a linear configuration into a paper pulp line.

FIG. 1 depicts a paper making machine in schematic side and top elevational views, with a long strainer 1, a pulp discharge 3, discharge tubes 17, a control unit 18 for the discharge tubes 17, an automatic valve 19 in discharge tube 17, a pump 20 for the circulation of marking substance and a supply container 26 for the marking substance for the partial integration thereof. Furthermore, test zones 14 containing marking substance are shown.

Figure 2:
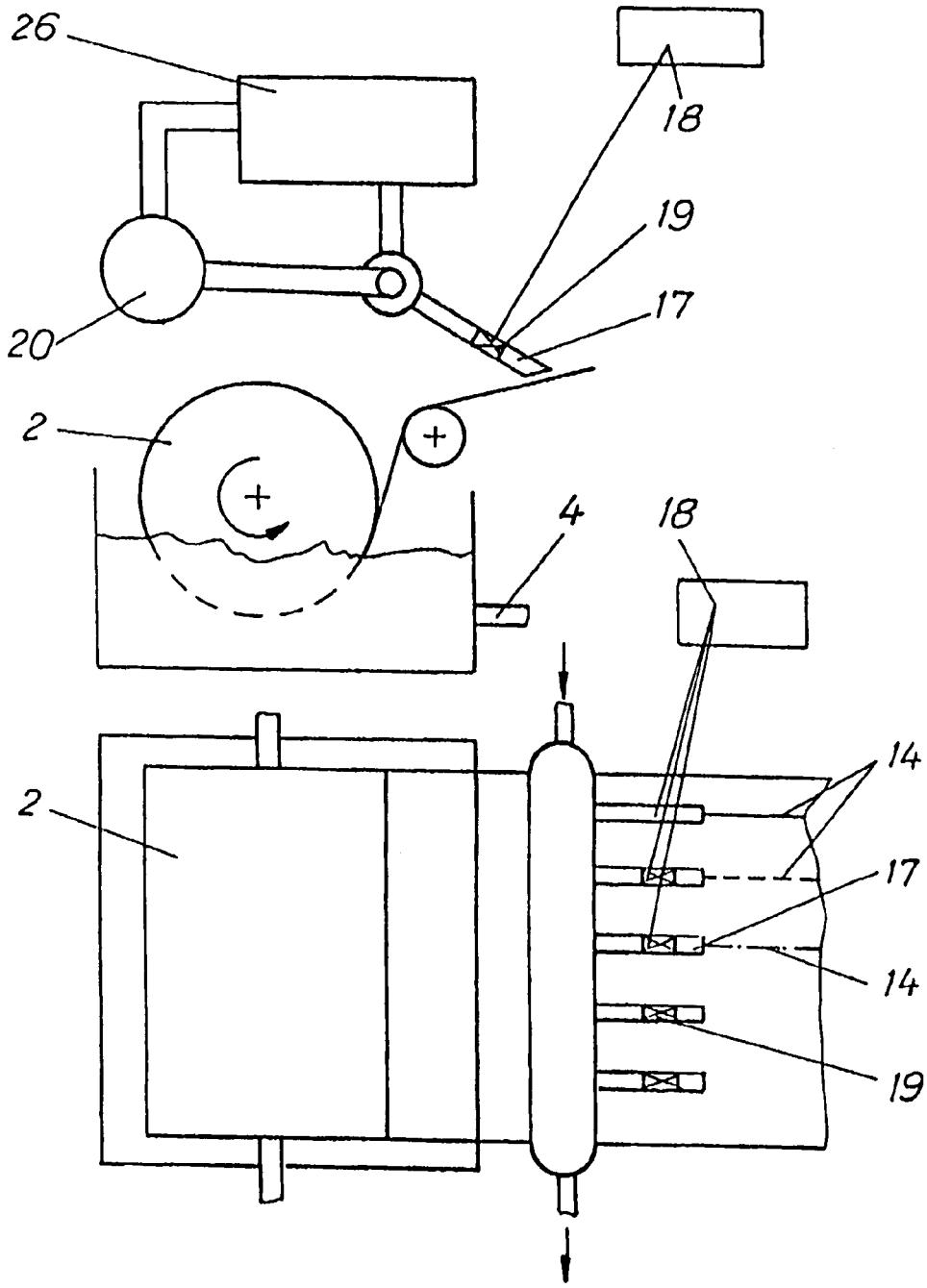
FIG. 2 depicts schematic side and top elevational views of a round strainer of a paper making machine for illustrating the same method.
Figure 3:
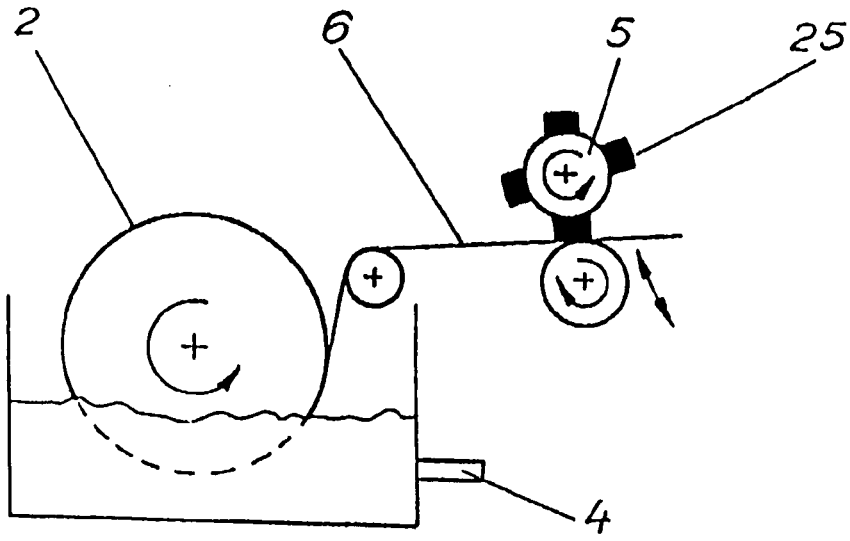

FIG. 2 depicts a round strainer 2 of a paper making machine in schematic side and top elevational views with a pulp input 4, partial test zones 14, discharge tube 17, control unit 18 for the discharge tubes 17, the automatic valve 19 in every discharge tube 17, the pump 20 for the circulation of the marking substance and the supply container 26 for the marking substance for the partial integration thereof.

FIG. 7 depicts the signal graph as a diagram of voltage U as a function of the number of channels during scanning of the optical scanner sensors 10 and of the capacitive scanning sensors 11 over a bank note with homogeneously distributed marking substance and with an electrically conductive embossed section. The sensor channels 1-14 are depicted schematically.

FIG. 7*a* depicts the combining of the signals of the optical scanning sensors 10, of the capacitive scanning sensors 11 and of the optical sensors 13 which actuate the capacitive scanning sensors 11 during testing of a web provided with partial test zones 14.

FIG. 8 is a schematic side elevational view of a water mark embossing roller 5 with embossing segments 25 and with a marking substance transfer roller 7, an electrically conductive test zone 9 structured as a water mark 9, a supply container 16 for marking substance and a pressure roller 27.

FIG. 8*a* depicts the signal graph as a diagram of voltage U as a function of the number of channels during testing of an electrically conductive test zone 9 in a paper web without marking substance.

FIG. 9 is a schematic presentation of testing the paper web provided with the different partial test zones 14*a*, 14*b*, 14*c* by the capacitive scanning sensors 11 and optical sensors 13 for their actuation following a partial integration of marking substance into the paper pulp line 6.

FIG. 10 depicts signal graphs 23 of the partial marking substance detection according to the arrangements of FIG. 9.

FIG. 11 depicts a foil structure with a support foil 28, a metallization 29 and a further layer 30 of an electrically conductive polymer.

FIG. 12 depicts another foil structure with a support foil 28, a metallization 29 and a further layer 30 of an electrically conductive polymer.

FIG. 13 depicts a foil structure with two support foils 28; 28' and a metallization 29, each support foil 28, 28' carrying a further layer of an electrically conductive polymer.

FIG. 14 depicts a foil structure with two support foils 28, 28', a metallization 29 and a further layer 30 of an electrically conductive polymer.

Example 1

FIGS. 1 and 2 depict the manner in which a partial application of polyethylene dioxythiophene polystyrene sulfonate (PEDT/PSS) is accomplished by metering devices positioned precisely over the paper pulp line 6. The prerequisite for a uniform supply of the metering devices with marking substance is a continuous circulation of the paper pulp in the entire tubular system including the supply container 26 of the marking substance to be partially integrated, by means of the pumps 20. The marking substance is partially applied to, or integrated into, the paper pulp line by an array of metering devices each consisting of an output tube 17 with an automatic valve 19. This leads to the formation, under the control of the valves 19, of linear continuous test zones 14*a*, discontinuous test zones 14*b* or dotted test zones 14*c*. In this connection, see also FIG. 9. When the dried paper web is cut into sheets partial test zones 14 with the marking substance result. These may extend over the entire width or length of the sheet, or they may be present as sections over the length or width of the sheet. The width of the lines or line sections must be adjusted to the resolution of the scanning sensors 10; 11. Preferably, the width of the line is chosen to be 2 mm.

The use of the electrically conductive polymer polyethylene dioxythiophene polystyrene sulfonate (PEDT/PSS) results in the advantage of its good compatibility with the other ingredients of the paper pulp. The integration into the paper pulp is thus substantially less complicated than it is with solid marking substances since the electrically conductive polymer polyethylene dioxythiophene polystyrene sulfonate is also available in liquid form. The required concentrations make possible an almost transparent electrically conductive marking.

Example 2

FIG. 8 shows how a printed image of PEDT/PSS is produced on the paper web 6 by means of the embossing roller 5 and the marking substance transfer roller 7. The imprint of the embossing segments 25 corresponds to the pictorial rendition of the electrically conductive test zone 14 shown as a water mark 9.

Example 3

FIGS. 1 and 2 depict how the test zones 14 in the paper web 6 are examined for any partial or homogeneous presence of marking substance. The test result derived therefrom affects, by way of the control unit 18, the automatic valves 19 in the discharge tubes 17.

As has already been mentioned, FIGS. 7, 7*a*, 8*a*, 9 and 10 depict the testing in different applications, with corresponding signal graphs.

Based on a water mark in the embossed area 24, FIG. 7 depicts the testing of the electrical conductivity of the paper web 6 as a reference test relative to the test of the pictorial structure of the water mark 9. The paper web with the water mark sequentially moves in the direction of the arrow through an array of optical scanning sensors 10 and a further array of capacitive scanning sensors 11. The associated signal graph depicts the matching voltage course of the optical scanning sensors 10 and of the capacitive scanning sensors 11, shown here as a function of the number of the channels.

As shown in FIG. 7*a*, here, too, the sensor channels are sequentially energized in the manner described above.

FIGS. 9 and 10 show the examination of linearly deposited PEDT/PSS as marking substance on the paper web as well as the signal graphs 23 generated thereby.

In FIG. 9*a*, the paper 6 contains a test zone 14*a* with a continuous linear application of PEDT/PSS as marking substance. When passing through a test facility consisting of optical sensors 13 and capacitive scanning sensors 11, a corresponding continuous voltage curve U=f(t) is generated in the signal graph 23.

In FIG. 9*b*, the application of the PEDT/PSS as marking substance is shown as a pattern interrupted at regular intervals. During testing, a signal graph 23 is generated with corresponding regular breaks in the voltage curve U=f(t).

In FIG. 9*c*, the application of PEDT/PSS as marking substance in the test zone 14*c* is shown as a pattern of irregularly interrupted intervals. This, too, is reflected in the resulting signal graph 23.

Example 4

Hereafter, use of the electrically conductive PEDT/PSS as marking substance is explained with reference to FIGS. 11 to 14 in the context of a foil structure incorporated in a paper pulp line 6.

The foil structure of the security element to be included in a paper pulp line contains a support foil 28 made, for instance, of polypropylene, of a thickness of preferably 40 μm. A metallization 29 applied to the support foil 28, for instance, by vapor deposition or sputtering, is of an additional thickness of about 2 nm.

The metallization 29 is provided with demetallized sections shaped, for instance, as letters or numbers, which can be recognized in transmitted light by the naked eye. The demetallization extends sectionally up to the edge of the support foil 28. At its obverse side the support foil 28 is provided with a further layer 30 made of the PEDT/PSS. The specific PEDT/PSS (polyethylene dioxythiophene polystyrene sulfonate) in accordance with formula CPP105 is applied on the support foil 28 at a thickness of 1 μm to 2 μm. The addition of the further layer 30 results in a negligible increase in thickness. The foil structure with the marking substance in accordance with the invention included into the paper web as a security element does not because of its insignificantly changed thickness adversely affect documents or bank notes made from the paper web, even in a stack of considerable height. Neither will the paper be weakened because of its increased thickness at the position where the security element is embedded.

The metallization 29 applied to the support foil 28 by vapor deposition or sputtering, for instance, has a thickness of a few atomic layers and, depending upon the surface structure of the support foil, is thus relatively brittle. Folding, bending or creasing leads to arbitrarily distributed hairline fissures which render impossible any intended measurement of the conductivity of predetermined sections of the metallization 29. By contrast, the other layer 30 made of PEDT/PSS is flexible and elastic and, compared to the metallization 29 and depending upon the surface structure of the support foil 28, is of a much higher ductility. Even when bending, creasing or folding a bank note, for instance, no interruption of the further layer 30 of PEDT/PSS will result. Hence, the testing devices installed, for instance, in automatic teller machines will now derive, for predetermined sections of the security element, a value of the conductivity from the metallization 29 applied in accordance with the state of the art with possible hairline fissures and from the relatively high-ohmic layer 30 of PEDT/PSS connected in parallel to the metallization 29.

Example 5

A preferred embodiment of the foil structure including PEDT/PSS as the inventive marking substance for a security element for instance in a bank note, is depicted in FIG. 11. FIG. 11 depicts the support foil 28 on one side of which the metallization 29 has been applied. The other side of the support foil 28 carries the further layer 30 of PEDT/PSS.

The further layer 30 of PEDT/PSS is applied to the carrier foil 28 by conventional technological processes, for instance, by calendering. This leads to a compound or laminated foil, to which the metallization 29 is subsequently applied by vapor deposition, for instance.

Of course, it would also be possible to apply the further layer 30 of PEDT/PSS subsequent to vapor deposition of the metallization 29 on the support foil 28. In such a foil structure, the further layer 30 would bring about a certain protective action in respect of the metallization 29.

Example 6

FIG. 12 depicts another preferred embodiment of the foil structure with PEDT/PSS as the marking substance in accordance with the invention. The support foil 28 and the metallization 29 are shown. A further layer of PEDT/PSS is disposed between the support foil 28 and the metallization 29 as a bonding agent. The arrangement of the further layer 30 of PEDT/PSS as a bonding agent is not limited to improving the adhesion between the support foil 28 and metallization 29. The further layer 30 of PEDT/PSS may be applied between any other desired foils or layers for improving their bond. However, used as a bonding agent between the support foil 28 and the metallization 29 results in the advantage that on the substantially more elastic further layer 30 of PEDT/PSS the relatively brittle metallization 29 can withstand substantially higher mechanical stresses than if vapor deposited directly on the support foil 28.

Example 7

FIG. 13 depicts a foil structure for a security element with PEDT/PSS as the marking substance in accordance with the invention using a support foil 28 to which a metallization 29 has been applied. The metallization 29 is covered by a further support foil 28'. This is done, for instance, for the protection of the metallization 29 if, with an interrupted thread or strip partially embedded in the paper web, it is subjected to higher stress. Increased stresses during the technological process of paper production are a further reason for the use of the further support foil 28'. At least one of the support foils 28; 28' is provided with the further layer of PEDT/PSS.

Example 8

In FIG. 13, both support foils 28; 28' are provided with a further layer 30 of PEDT/PSS, whereas FIG. 14 depicts an embodiment in which only one of the support foils 28 is provided with the further layer 30 of PEDT/PSS.

The invention is not restricted to the inventive marking substance PEDT/PSS is used as a further layer 30 in a foil structure. The marking substance PEDT/PSS in accordance with the invention may be included in the paper pulp line as a security element of any desired configuration.

Example 9

The improved certainty against counterfeiting is served by providing, in addition to the electric conductivity, further security elements and by combining them appropriately. Thus, for instance, in addition to the electric conductivity of PEDT/PSS there may be provided marking pigments which can be recognized by the naked eye as well as those which can be detected only by appropriate testing devices, with special light sources and optical sensors. Moreover, the invention also extends to the combination of the electric conductivity and such additives which posses magnetic properties. Of particular advantage, in the context of the invention, is a combination of the electric conductivity and optical and magnetic marking substances. As a preferred application, mention is to be made of hiding the additives with magnetic properties by adding marking pigments visible to the naked eye. In this manner, a potential counterfeiter will be uncertain about the presence of a magnetically active substance, particularly in view of the fact that the quantities used are small and that their magnetic effects cannot be easily detected.

In addition to the mere presence of optically effective additives in the PEDT/PSS, the invention extends to arranging the optically effective additives within the electrically conductive polymer in a manner resulting in optical encoding, such as, for instance, a dye pattern which may be evaluated by testing devices. The same is applicable to the magnetically effective additives the inventive arrangement of which leads to magnetic encoding such as a magnetic line code, for instance.

What is claimed is:

1. A method comprising:

providing a sheet material having a wet pulp state;

applying to said sheet material while said sheet material is in said wet pulp state a pattern of PEDT/PSS;

wherein said sheet material comprises paper and a foil and said applying comprises applying said pattern of PEDT/PSS to said foil;

further comprising embedding said foil in said paper while said paper is in said wet pulp state thereof; and wherein said foil comprises a first support foil provided with a metallization comprising sectional demetallizations covered by a at least a further layer comprising PEDT/PSS.

2. The method of claim 1, wherein said pattern of PEDT/PSS is applied as a bonding agent between at least said first support foil and said metallization and between said first support foil and said paper in said wet pulp state.

3. The method of claim 2, wherein a layer of PEDT/PSS is applied to said first support foil on the surface thereof opposite said metallization.

4. The method of claim 2, wherein said metallization is applied to one surface of said first support foil and the PEDT/PSS is applied as a layer on said metallization.

5. The method of claim 1, wherein said metallization is covered by a further support foil and at least one of the first and further support foils is covered by a layer of PEDT/PSS.

6. The method of claim 1, wherein the elasticity coefficient of the layer of PEDT/PSS is greater than the elasticity coefficient of said metallization.

7. A method comprising:
providing a sheet material having a wet pulp state;
applying to said sheet material while said sheet material is in said wet pulp state a pattern of PEDT/PSS; and
further comprising embossing said sheet material there thereby change a density of said a pattern of PEDT/PSS resulting from said applying.

8. A method comprising:
providing a sheet material having a wet pulp state;
applying to said sheet material while said sheet material is in said wet pulp state a pattern of PEDT/PSS; and
further comprising imprinting said sheet material to thereby change a density of said a pattern of PEDT/PSS resulting from said applying.

9. A method comprising:
providing a sheet material having a wet pulp state;
applying to said sheet material while said sheet material is in said wet pulp state a pattern of PEDT/PSS; and
further comprising testing homogeneity of said pattern of PEDT/PSS and then controlling said applying based upon results of said testing.

10. A method of using a sheet product obtained by the process comprising:
providing a sheet material having a wet pulp state;
applying to said sheet material while said sheet material is in said wet pulp state a pattern of PEDT/PSS; and
said method of using comprising determining whether regions of said product are electrically conductive.

11. The method of claim 10 wherein said determining comprising spacing a set of control channel elements from one another and moving said product adjacent said control channel elements, and further comprising alternatively energizing even and odd members of said set of control channel elements, thereby reducing cross talk in said control channel elements.

12. A method comprising:
providing a sheet material having a wet pulp state;
applying to said sheet material while said sheet material is in said wet pulp state a pattern of PEDT/PSS; and
further comprising applying to said sheet material an additional metallization layer formed from a material other than PEDT/PSS.

13. The method of claim 12 wherein said additional metallization layer is applied to a side of said sheet material opposite the side to which said pattern of PEDT/PSS is applied.

14. The method of claim 13 wherein said additional metallization layer is applied on said pattern of PEDT/PSS.

15. A method comprising:
providing a sheet material having a wet pulp state;
applying to said sheet material while said sheet material is in said wet pulp state a pattern of PEDT/PSS;
further comprising providing a second sheet material and a second layer of PEDT/PSS;
wherein said second sheet material and said sheet material are separated from one another by an additional metallization layer formed from a material other than PEDT/PSS; and
wherein said sheet material and said second sheet material each contact said additional metallization layer.

16. A method comprising:
providing a sheet material having a wet pulp state;
applying to said sheet material while said sheet material is in said wet pulp state a pattern of PEDT/PSS; and
wherein said pattern of PEDT/PSS has thickness of 1 to 2 microns.

17. A method comprising:
providing a sheet material having a wet pulp state, said sheet material having a first side and a second side; and
applying to said first side of said sheet material while said sheet material is in said wet pulp state a pattern of an electrically conductive polymer;
further comprising applying an additional metallization layer to said sheet material.

18. A method comprising:
providing a sheet material having a wet pulp state, said sheet material having a first side and a second side; and
applying to said first side of said sheet material while said sheet material is in said wet pulp state a pattern of an electrically conductive polymer;
further comprising applying an additional metallization layer to said second side of said sheet material.

* * * * *